United States Patent [19]

Kapp

[11] Patent Number: 4,930,391

[45] Date of Patent: Jun. 5, 1990

[54] METHOD AND APPARATUS FOR FATIGUE AND FRACTURE TESTING OF LARGE CALIBER CANNONS

[76] Inventor: Joseph A. Kapp, 25 Elmhurst Avenue, Rensselaer, N.Y. 12144

[21] Appl. No.: 383,980

[22] Filed: Jul. 24, 1989

[51] Int. Cl.[5] ..... F41A 31/02

[52] U.S. Cl. ..... 89/1.1; 73/167

[58] Field of Search ..... 89/1.1, 14.05; 102/355, 102/435; 73/167

[56] References Cited

U.S. PATENT DOCUMENTS 2,789,428 4/1957 Mackas ..... 73/15
3,626,451 12/1971 Bourgeot ..... 73/167
3,863,499 2/1975 Von Boutteville et al. ..... 73/167
4,263,807 4/1981 Brown et al. ..... 73/167
4,793,179 12/1988 Carlson ..... 73/167

*Primary Examiner*—Charles T. Jordan
*Assistant Examiner*—Rochelle Lieberman
*Attorney, Agent, or Firm*—Schmeiser, Morelle & Watts

[57] ABSTRACT

Fatigue and fracture testing of a larger caliber cannon is accomplished by explosively thermally decomposing within the cannon bore acetylene of 0.27 grams per cc density and repeating this operation a predetermined number of times or until the surface and subsurface portions of the bore exhibit microstruictrual and other changes characteristic of those resulting from actual firing operations.

7 Claims, 1 Drawing Sheet

METHOD AND APPARATUS FOR FATIGUE AND FRACTURE TESTING OF LARGE CALIBER CANNONS

The Government of the United States has a non-exclusive, irrevocable, royalty-free license in the invention disclosed and claimed herein and under any patent which may be granted thereon.

FIELD OF THE INVENTION

The present invention relates generally to the stress-corrosion testing art and is more particularly concerned with a novel method for fatigue and fracture testing large caliber cannons, and with new apparatus implementing that method.

BACKGROUND OF THE INVENTION

Development and production of modern large caliber cannon require tests reliably simulating firing conditions of intended use. Thus, present general practice involves loading a cannon with solid propellant and igniting it to Produce high pressure gas consisting largely of carbon monoxide and carbon dioxide at temperatures between 3400° F. and 4050° F., and repeating the operation a predetermined number of times or until the cannon bore exhibits significant metal transformation. This is an expensive and time consuming procedure, typically involving at least a year or two and cost in millions of dollars for each complete test run of a cannon test specimen.

SUMMARY OF THE INVENTION

By virtue of my new concept and discoveries set forth below, it is now possible to conduct such fatigue and fracture tests relatively quickly and inexpensively. Further, this highly desirable result can be obtained without offsetting disadvantage and particularly without compromising reliability of test results. More specifically, this invention enables full testing of a cannon test specimen within a matter of weeks at a total cost on the order of a tenth or less than that of the present standard test procedures.

A principal novel concept underlying this invention is the use of explosively thermally decomposable hydrocarbon gas instead of a solid propellant to create in a cannon simulated firing conditions.

I have found that there are critical circumstances necessary to obtain the desired results. Further, I have found that by charging gaseous ethylene, acteylene or a mixture thereof into the cannon test specimen and then thermally decomposing the hydrocarbon, conditions can be created which will cause changes in the cannon bore surface and subsurface regions essentially identical to those resulting from normal firing of the cannon. Thus, surprisingly, the etch resistant "white layer" phenonmenon associated with firing erosion of cannon tubes can be consistently produced. Specifically, I have found that test results corresponding to the firing of 1500 rounds of ammunition in a Navy gun is equivalent to 380 test decompositions, and 1500 rounds of NACO propellant in a Navy gun is equivalent to 42 test decompositions. Further, the "white layers" are produced in the course of only nine test decompositions of this invention.

The kind of gas charged and the density of the gas as it exists in the cannon immediately before thermal decomposition are highly critical features of this invention. Additionally, it is important as a practical matter to heat the cannon specimen and associated metal parts to a temperature above the condensation temperature of the hydrocarbon gas to be introduced into the cannon in carrying out a test in accordance with this invention.

Additional significant features and conditions of the process and apparatus of this invention will become apparent from the detailed description set forth below.

Briefly described, the novel method of this invention comprises the steps of filling a cannon closed at its ends with an explosively thermally decomposable gas, pressurizing and heating the gas and thereby detonating it, then relieving the gas pressure in the cannon, repeating the cycle a number of times and then examining the cannon bore surface and subsurface for fractures and microstructural changes.

Likewise described in general terms, the new apparatus of this invention comprises, cannon barrel end sealing means, barrel heating means, gas delivery means, gas heating means in the barrel, gas pressure intensifying means, barrel gas exhaust means, and means for controlling gas flow into and out of the cannon barrel in the course of testing operation. cl BRIEF DESCRIPTION OF THE DRAWINGS FIG. 1 is a side elevational view of a fatigue and fracture testing apparatus for large caliber cannons.

DETAILED DESCRIPTION OF THE INVENTION

Figure 1:
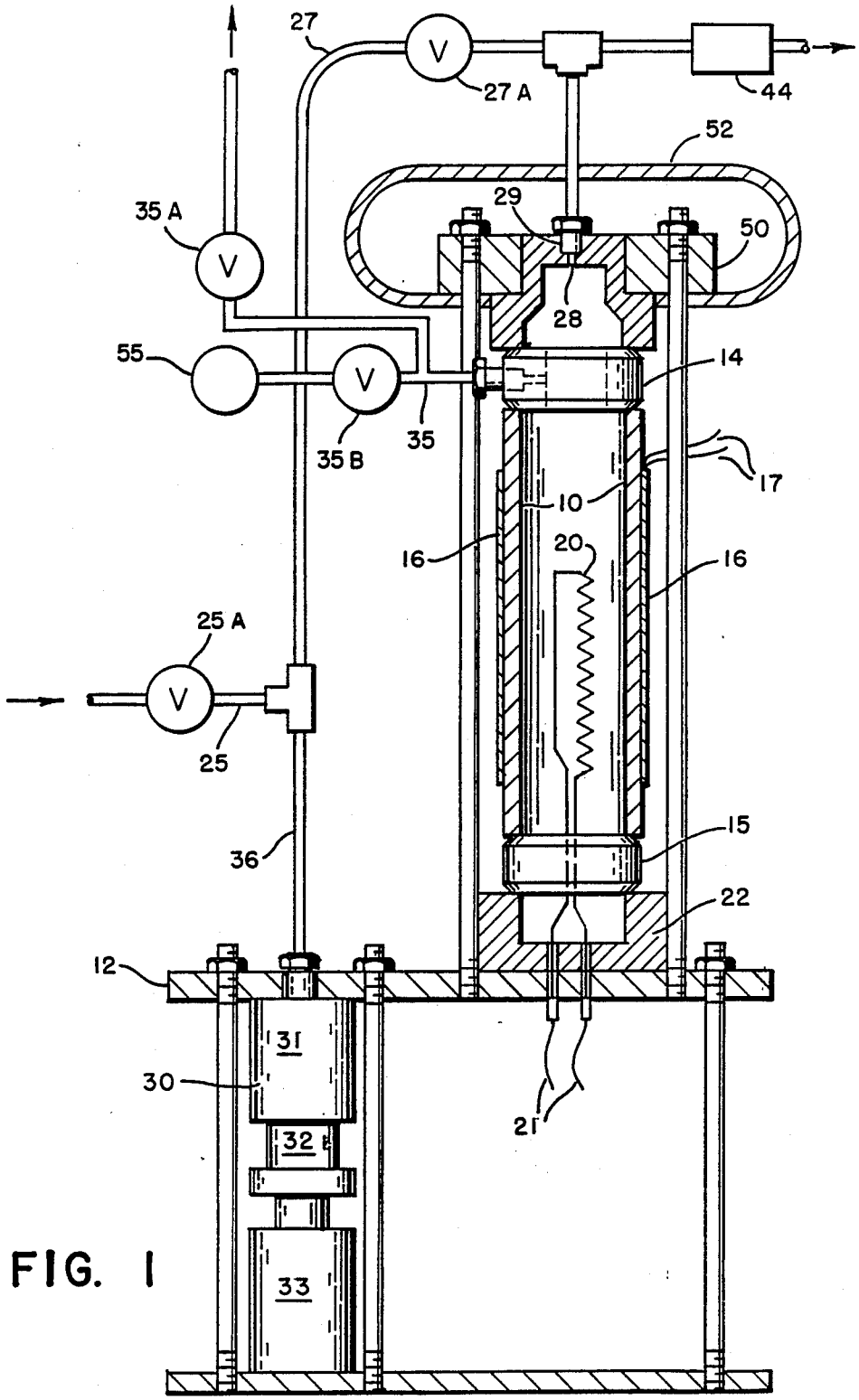

Apparatus embodying this invention in preferred form is illustrated in the drawing accompanying and forming a part of this specification. As shown in somewhat dagrammatic form in that drawing, a test specimen tube 10 representing a large caliber cannon barrel is mounted in a supporting fixture or frame 12 and closed at the ends with high pressure lens ring seals 14 and 15. Electrical resistance heater tapes 16 are applied to the outside of tube 10 and connected by leads 17 to an electric power source (not shown).

An internal heater in the form of an electrical resistance coil 20 is positioned in tube 10 and connected to an external electric power source (not shown) by leads 21 through electrical pass-through 22.

Gas is charged into tube 10 from a pressurized gas supply source (not shown) through gas supply line 25 and pipe 27 and aperture 28 in blow out plug 29. Valves 25A and 27A control gas flow through line 25 and pipe 27, respectively.

A gas pressure intensifier 30 comprising a cylinder 31, a piston 32 and a hydraulic ram 33 serves the purpose of increasing the pressure of the gas charge in tube 10, as will be described in more detail below. Thus cylinder 31 communicates with tube 10 through pipe 27.

An exhaust system for removing gas from tube 10 following detonation of a gas charge composes an exhaust pipe 35 communicating with tube 10 through lens ring seal 14 and open to the atmosphere at its other end, valve 35A in pipe 35 serving to control exhaust gas flow from the tube.

For purposes of safety in the practice of this invention, blow out plug 29 is secured in position bearing tightly against lens ring seal 14 by retaining flange 50 of support frame 12. A safety strap 52 is attached to the blow out plug and held in place by flange 50 to contain the plug if it should fail under gas pressure in tube 10 and break away from flange 50. Finally, a rupture disc assembly, 44, serves pipe 27 and tube 10 to relieve excessive gas pressure that may be produced at dentonation.

A gas pressure gauge 55 for sensing and indicating gas Pressure within tube 10 communicates with the tube through exhaust pipe 35, valve 35B serving to open the gauge for Pressure readings and to isolate gauge 55 at other times such as during detonation.

Carrying out the method of this invention using the illustrated apparatus in accordance with my present preference, tube 10 is secured in position in fixture 12 and fitted at its ends with lens ring seals 14 and 15 gas tightly sealing them with heater coil 20 in place in the tube and leads 21 connected to an external power source via electrical Pass through 22. Tube 10 is heated to slightly above 98°F. by heater tapes 16 and then acetylene gas is delivered through line 25 and pipe 27 into tube 10 from an outside supply source, suitably a commercial gas cylinder. This preheating of the tube prevents condensation of the acetylene inside the tube during charging.

Regarding the matter of gas pressure, it is possible to, decompose acetylene at pressures well below that required for such decomposition of ethylene. In both cases, however, the higher the gas pressure, the better are the results for practical reasons I would not attempt to practice this invention using ethylene gas of density below about 0.4 gram per cc or acetylene gas of density less than about 0.1 gram per cc. My preference in the case of ethylene is about 0.5 gram per co and in the case of the acetylene is about 0.27 grams per cubic centimeter. Accordingly, the charge in tube 10 which is initially at between 1 and 17 atmospheres (the usual commercial acetylene cylinder gas pressure) is subjected to additional pressure by action of pressure intensifier 30. Thus, with valve 27A closed after the first gas charge is delivered into tube 10, valve 25A is opened to allow acetylene from a cylinder supply source to enter pipe 27 and cylinder 31 of gas pressure intensifier 30. Valve 25A is then closed and valve 27A is opended to admit gas into tube 10 under pressure applied by piston 32 driven by hydraulic ram 33. This sequence is repented until the acetylene gas pressure in tube 10 as indicated by gauge 55 is at the level desired by the operator, preferably that corresponding to density about 0.27 g/cc. The same procedure is also preferred in use of ethylene gas except that as stated above the density will be as high as practicable for best results. In any event, throughout gas charging operations the exhaust system is closed by valve 35A but valve 35B should remain open to monitor gas pressure increases in tube 10.

When gas charge pressure in tube 10 has reached the desired level, valve 27A is closed, as is valve 35B, and resistance coil 20 is energized to heat the gas until it thermally decomposes explosively at a temperature of about 750°F. in the case of either acetylene, or ethylene.

Following detonation, if rupture disk assembly 44 or blow out plug 29 has not relieved the pressure the tube is opened to relieve the gas pressure therein and decomposed gas flows out of the tube through exhaust pipe 35 as valve 35A is opened.

This operation is normally repeated eight or nine times and then the tube is removed from the fixture and disconnected from power sources and the gas supply for visual examination of changes in the surface and subsurface portions of the bore. Thus, the inspection would reveal the presence of the "white layer" and microcracks developed during the course of the test firings.

It will be understood that the same procedure as generally set out and described also in detail above world be carried out in performing the process of this invention in the event that ethylene or some other explosively thermally decomposable hydrocarbon were used in place of acetylene or in the event that a mixture of acetylene and ethylene or another of these gases with others of them were to be used for this purpose. It would be necessary in such instances to meet the requirements indicated above for charging the gas and avoiding condensation of the charging gas within the test specimen, tube or cannon, and also to have the test specimen sealed adequately and to have the capability of bringing the gas charge in the cannon to the temperature necessary to cause detenation.

Implicit in all of the foregoing is the fact that the method of this invention yields test results which so closely simulate those of the prior art that they can be reliably used in large caliber cannon developmental and production operations. Thus, new materials research can be reliable expedited over prior practice as a principal consequence of this invention.

What is claimed:

1. The method of fatigue and fracture testing a ferrous metal tube which comprises the steps of closing the ends of the tube, then filling the tube with a charge of gaseous ethylene, acetylene or a mixture thereof under superatmospheric pressure, thereafter explosively decomposing the gaseous charge in the tube, then opening the tube and relieving the gas pressure therein, repeating the cycle a predetermined number of times, and finally examining the interior surface of the tube for fractures and for microstructural changes.

2. The method of claim 1 in which the charge consists of acetylene gas of density greater than about 0.25 grams per cubic centimeter.

3. The method of claim 1 in which the charge consists of ethylene of density greater than about 0.5 grams per cubic centimeter.

4. The method of claim 1 in which the tube is a large caliber steel cannon and the gas is acetylene, and including the step of subjecting the acetylene gas charge to increased pressure and thereby increasing the density of the gas to about 0.27 grams per cubic centimeter.

5. The method of claim 3 including the preliminary step of heating the tube to a temperature above about 98°F. to avoid condensation of acetylene in the tube, and the step of heating the acetylene charge in the tube when charging is completed to a temperature of about 750°F. and thereby causing the acetylene to thermally decompose explosively.

6. The method of claim 1 including the step of heating a close gas tube and thereby raising its temperature to the point at which a gas charge therein explosively thermally decomposes.

7. Cannon barrel fatigue and fracture testing apparatus comprising closure means including a first and second high pressure gas seals for gas tightly closing the ends of a cannon barrel, cannon barrel heating means including heating elements in contact with the barrel, gas heating means including an electric resistance coil positionable in the cannon barrel and leads for connecting the coil to an external electric power source, gas delivery means including a conduit to communicate with the interior of the cannon barrel and connectable to an external source of pressurized gas, gas exhaust means including a conduit to communicate with the interior of the cannon barrel for receiving and conducting gas in flow from the cannon barrel, cannon barrel gas pressure intensifying means including a source of super pressurized gas to communicate with the interior of the cannon barrel, and valve means including gas inlet and gas exhaust valves in the gas delivery conduit and the gas exhaust conduit respectively for controlling the flow of gas into and out of the cannon barrel in the course of a testing operation.

* * * * *